United States Patent [19]

Barale

[11] 4,290,985

[45] Sep. 22, 1981

[54] SHUTTERING SYSTEM FOR CASTING CONCRETE WALLS OR PARTITIONS, AND A METHOD FOR ITS ASSEMBLY

[76] Inventor: Giuseppe Barale, Via Provinciale 3, Roccaforte Mondovi (Cuneo), Italy

[21] Appl. No.: 158,081

[22] Filed: Jun. 10, 1980

[30] Foreign Application Priority Data

Mar. 28, 1979 [IT] Italy ..... 67643 A79

[51] Int. Cl.[3] ..... E04G 11/08

[52] U.S. Cl. ..... 264/31; 249/40; 249/219 W

[58] Field of Search ..... 249/33, 40, 219 W; 264/31

[56] References Cited

U.S. PATENT DOCUMENTS

| | | | |
|---|---|---|---|
| 2,312,983 | 3/1943 | Summers | 249/40 X |
| 3,185,433 | 5/1965 | Mueller | 249/219 W X |
| 3,558,095 | 1/1971 | McNiel | 264/31 X |
| 3,730,476 | 5/1973 | Prichard | 249/40 X |
| 3,734,453 | 5/1973 | Bailey | 249/40 X |
| 3,754,729 | 8/1973 | Maynen | 249/40 |

*Primary Examiner*—J. Howard Flint, Jr.

*Attorney, Agent, or Firm*—Sughrue, Mion, Zinn, Macpeak & Seas

[57] ABSTRACT

A shuttering system and a method for its assembly, employing metal uprights which are arranged to face each other in pairs and have fixing means spaced along the uprights on their sides facing the casting cavity. Stringers are inserted in removable hooked coupling elements attached to the fixing means, and panels are attached to the stringers to form two opposing shuttering surfaces. The panels are fixed to the stringers by nails or the like which are driven into parts of the stringers made from a soft material such as wood.

10 Claims, 13 Drawing Figures

P1
P2
LB
d1
d2

FIG. 13
FIG. 11
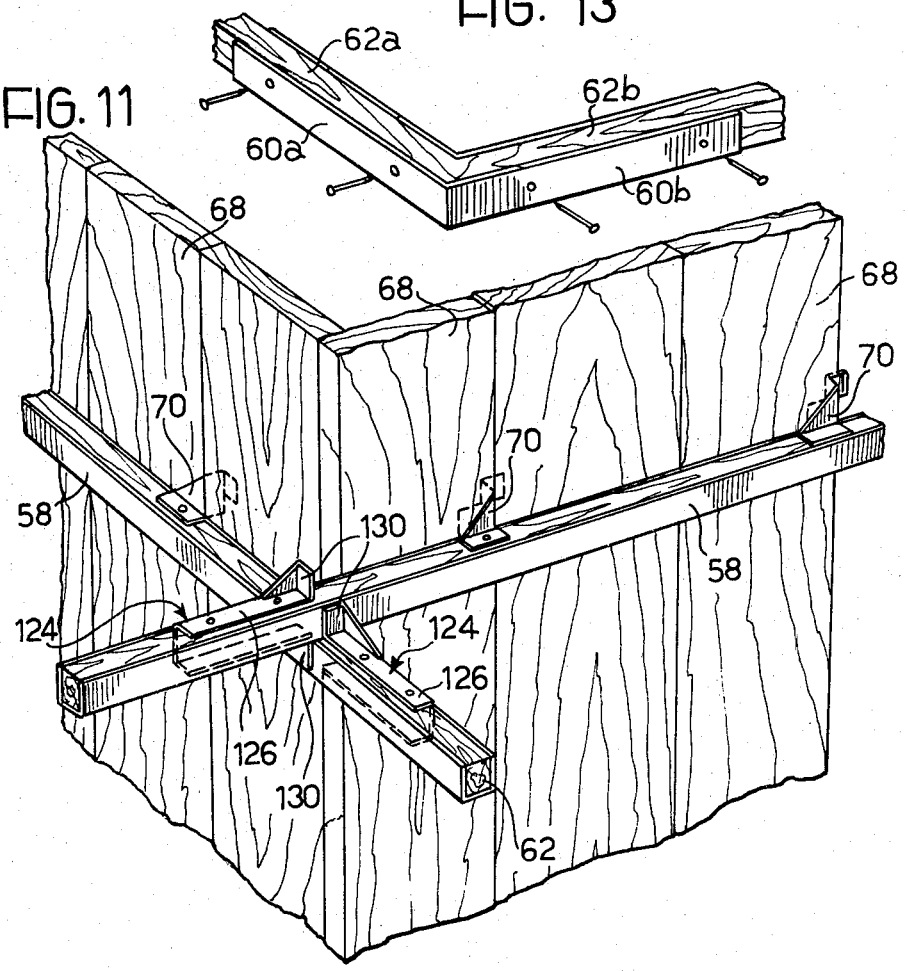
FIG. 9
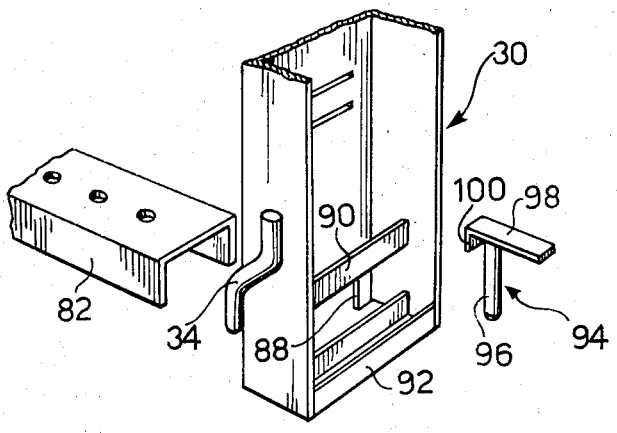
FIG. 12
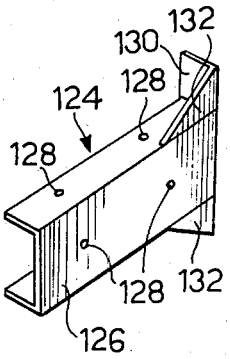

SHUTTERING SYSTEM FOR CASTING CONCRETE WALLS OR PARTITIONS, AND A METHOD FOR ITS ASSEMBLY

BACKGROUND OF THE INVENTION

The present invention relates to a shuttering system for casting a concrete wall or partition, and a method for assembling the system, in which two walls defining a casting cavity are each formed by adjoining panels supported by uprights having means which enable the perpendicularity of and spacing between the walls to be adjusted.

Already known from French Pat. Nos. 742,964 and 1,478,907 is a shuttering system of the type comprising metal uprights which are arranged to face each other in two spaced apart rows, respective panels which are fastened to each row of uprights to form a pair of flat opposing surfaces which define a casting cavity for the concrete, respective adjustable support means associated with respective uprights in one row to maintain said uprights in their vertical positions of use and enable adjustment of the transverse perpendicularity of the uprights and of the surface supported thereby, and respective lower and upper transverse connecting members for interconnecting the lower and uppers parts of the uprights in each row which face each other, the transverse members enabling the adjustment of the spacing between these lower and upper parts, and the adjustment of the perpendicularity of the surface supported by the uprights in the other row and its parallelism relative to the other surface.

This allows the adoption of an assembly procedure comprising the steps of: arranging metal uprights to oppose each other in two rows; interconnecting the lower and upper parts of each opposing pair of uprights by means of respective lower and upper transverse connecting members which permit the spacing between the lower and upper parts to be adjusted; attaching adjoining panels to the uprights of the two rows so as to form, between the rows of uprights, a pair of flat opposing surfaces which define a cavity for casting the concrete; adjusting the transverse perpendicularity of one row of uprights to adjust the perpendicularity of the surface supported thereby, and adjusting the spacing between the lower and upper parts of the uprights to adjust the perpendicularity of the other surface and the parallelism of the two walls.

French Pat. No. 742,964 describes the use of panels which are fixed directly to the internal faces of the uprights to form the walls of the casting cavity. These panels, which may be of wood, have a limited height, (about 80 cm), a varied length, and are subdivided into two or more adjoining portions which are interconnected by vertical joints, such as hinges or restrained joints. This subdivision of the panels is probably to permit economy of space during transport. It is obvious, however, that vertical joints, such as hinges or restrained joints, make these panels costly, necessitating their removal for re-use when a wall or partition has been cast, and also constitute weak zones in which the panels are susceptible to collapse under the lateral hydrostatic pressure of the liquid concrete, unless more expense is incurred in providing very strong joints. The presence of these weak zones is not so important when the panels are of a limited height, such as 80 cm. Such panels, however, only permit a wall or partition to be cast in successive stages of this limited height.

In order to cast in one stage a wall or partition of a height corresponding to that of a storey of a building, using the system described in French Pat. No. 742,964, it would be necessary to deploy uprights in correspondence with all the vertical joints, thereby requiring an excessive number of uprights.

According to French Pat. No. 1,478,907 the aforesaid drawbacks are partly eliminated by using metal panels which extend horizontally and are fixed one on top of the other against the uprights. The panels are secured to the uprights by means of a fairly complex fastening system which enables them to slide horizontally. In this case also, use is made of special panels which are expensive and which, therefore, should be re-used continuously.

The use of hinged rows of panels has another drawback: the length of the walls which may be obtained is dictated by the length of the available panels. Therefore, given the use of special panels, it would not be economically viable to provide a whole range of panels in a large number of different lengths.

The systems described in French Pat. Nos. 742,964 and 1,478,907 have in common the disadvantages of not permitting the use of economical panels, such as wooden boards, which are in common use in the construction industry, and of not allowing the use of panels which can be left in place after the concrete has set so as to form a cladding or wainscoting for the wall or partition, for example, for thermal and/or acoustic insulation.

The object of the present invention is to produce a shuttering system which enables the use of economical panels, such as wooden boards, which can be left in place, and which permits the casting of walls or partitions of any length.

SUMMARY OF THE INVENTION

According to the present invention there is provided a shuttering system of the type previously referred to wherein each upright of each row has a plurality of fixing means spaced along its side which, in use, faces the casting cavity, the system further including coupling elements for fastening to said fixing means, and stringers which are engageable with at least two said coupling elements fixed at substantially the same level on respective adjacent uprights, the stringers being at least partially made from a material soft enough to receive and retain driven fastening members, having an exposed face of said soft material, and having at least one flat side suitable for engagement in the coupling element in such a way that said flat side faces said casting cavity, in use, and defines a vertical plane with said flat sides of neighbouring stringers, the panels defining the opposing surfaces of the casting cavity being elongate and of arbitrary widths, and being fastened side by side to the flat sides of the stringers by said driven fastening members. The stringers permit economic panels, such as wooden boards to be fixed side-by-side. This enables a large assortment of panels of different widths to be provided at little expense, thereby eliminating any difficulty in erecting any desired length of wall or partition.

The stringers, the quantity and distribution of which may be selected as convenient, enable the hydrostatic thrust of the uncured liquid concrete to be transferred to the uprights. In addition, the spacing of the uprights may be selected arbitrarily, since this spacing is not dictated by the width of the panels.

BRIEF DESCRIPTION OF THE DRAWINGS

The invention will now be described in greater detail, reference being made by way of example to the accompanying drawings, in which:

FIG. 9 is a perspective view of the lower part of an upright and of the cooperating end of a lower transverse member;

FIG. 11 is a perspective view, on an enlarged scale, of a corner area such as that encircled at XI in FIG. 1;

FIG. 12 is a perspective view, on an enlarged scale, of a thrust-bearing element used at a corner connection such as that shown in FIG. 11, and FIG. 13 is a perspective view of a right-angled stringer for use in a corner area.

DESCRIPTION OF THE PREFERRED EMBODIMENTS

The component parts and details of the shuttering system will be described with reference to the drawings, during the course of describing the assembly procedure.

When preparing to cast a concrete wall or partition, a pair of wooden planks 10 and 12 (FIGS. 1, 2 and 7) are laid on a slab, or other horizontal surface with a preformed base, parallel to and spaced from each other. The two planks 10 and 12 are arranged at a predetermined distance from each other, with the plank 10 parallel to and spaced at a predetermined distance from a base line LB of one face of the wall or partition to be cast.

Support means, comprising tripods 14 are placed on the planks 10, 12 at predetermined or desired intervals.

Figure 2:
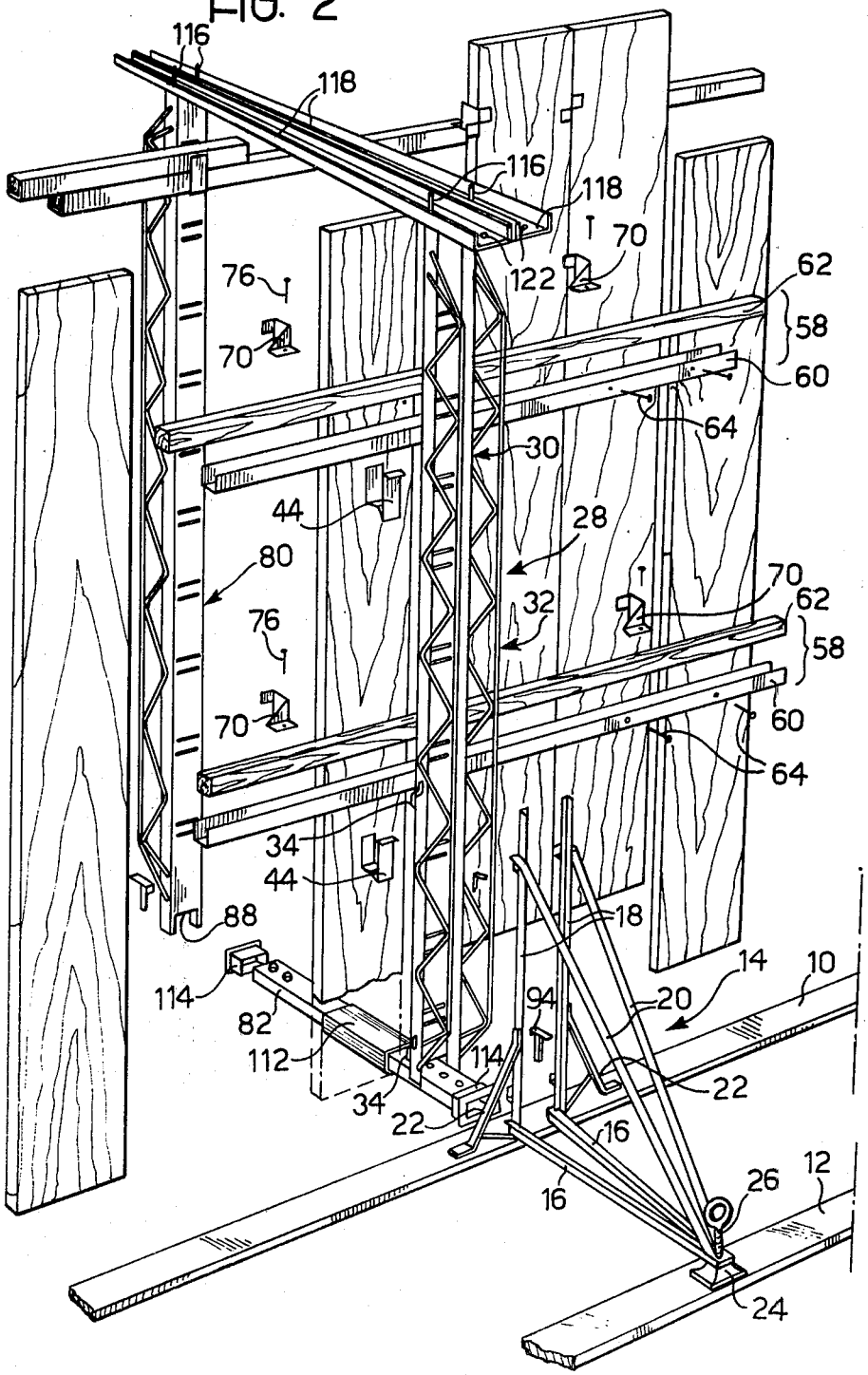
FIG. 2 is an exploded perspective view of a detail of FIG. 1 on an enlarged scale.
Figure 3:
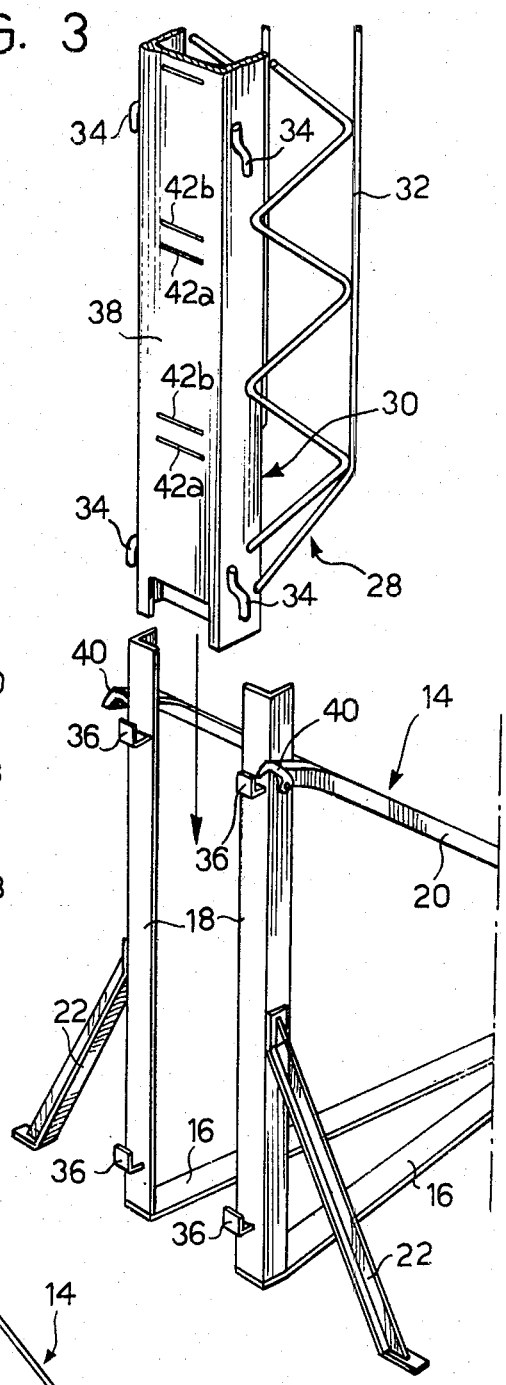
FIG. 3 is a perspective view of the lower part of an upright of the system, and of a supporting tripod for the upright.

Each tripod 14 is formed by a framework of profiled members which, when seen from the side, are shaped like right-angled triangles. The lower, substantially horizontal, side of the triangle is defined by a pair of elements 16, another, substantially vertical side is defined by a pair of elements 18, and the third, inclined, side is defined by a pair of struts 20 (FIG. 2). The corner angles formed by the connection of the elements 16 and 18 are placed on the plank 10. Each element 18 is provided with a lateral leg 22. The two legs 22 also rest on the plank 10 to prevent the tripod 14 from tipping sideways. The corner angle formed by the connection of the elements 16 and 22 has a foot 24 with an adjustment screw 26 which serves to adjust the perpendicularity of the element 18, as will be explained below.

The tripods 14 are placed on the plank 10, 12 so that, as far as possible, they are in alignment with each other.

When the tripods 14 are in position, each is combined with a respective upright 28 (FIGS. 1 to 5, 7, 9 and 10).

Each upright 28 includes a U-shaped element 30 of strong sheet metal. A reticular reinforcing structure 32 is welded to the sides of the element 30.

A pair of vertically spaced side coupling members 34 are welded to each of the side walls of the U-shaped elements 30 to engage in corresponding pairs of coupling members 36 of the parallel vertical elements 18 of tripod 14. The coupling of the cooperating members 34, 36 is such that the upright 28 is held in an erect position in which a flat external face 38 of the U-shaped element 30 is parallel to the tripod elements 18. The elements 18 also carry, adjacent the upper coupling members 36, respective pivoted locking hooks 40 which are engageable with the upper coupling members 34 of the upright 28 to render the connection between the upright 28 and its supporting tripod 14 more secure.

Each upright 28 is of a slightly greater length than the height of the wall or partition to be vast (3.25 meters, for example, for casting a wall or partition 3 meters high).

Figures 1, 5:
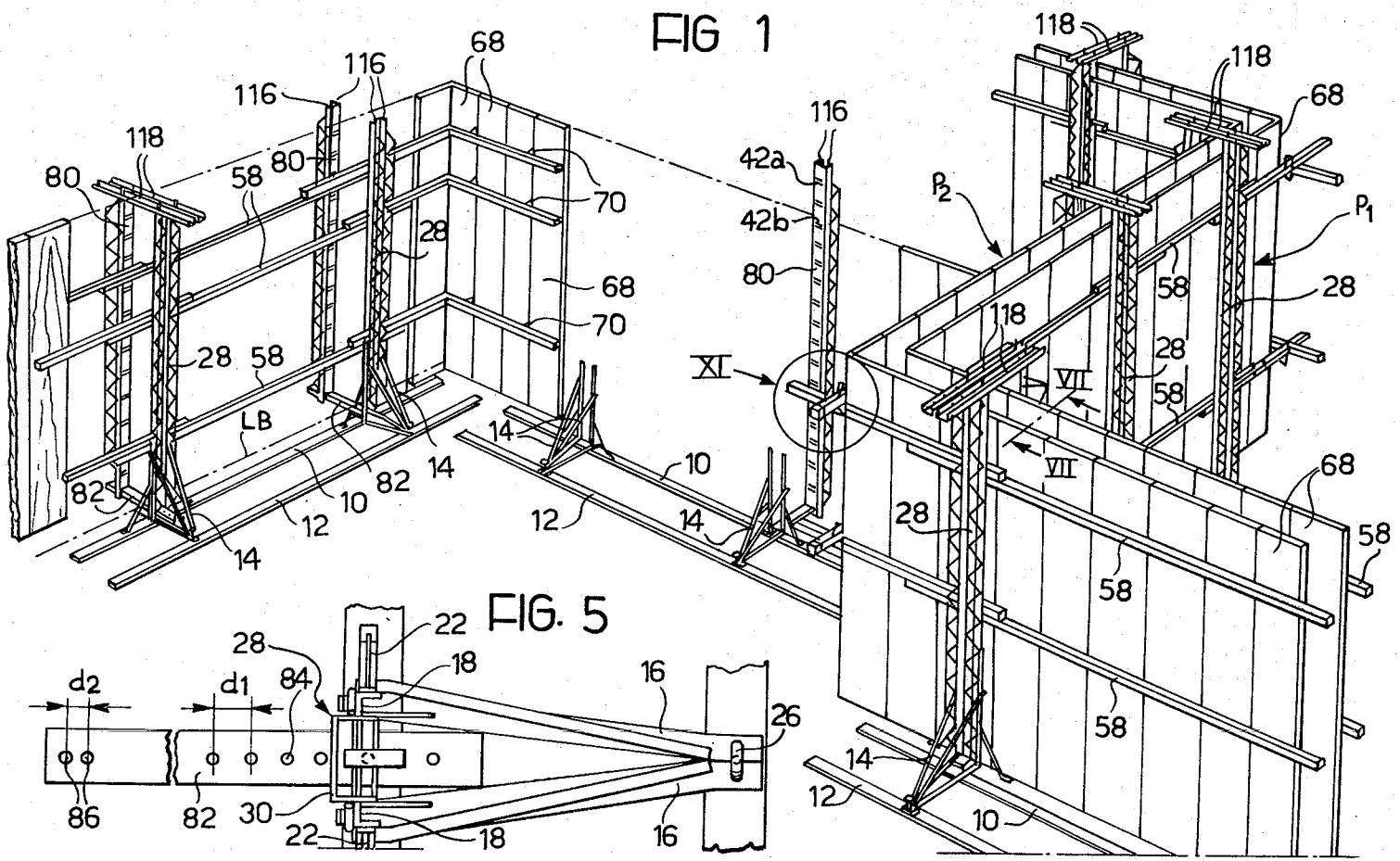
FIG. 1 is a perspective view of a shuttering system according to one embodiment of the invention being used in the casting of a wall or partition.
FIG. 5 is a plan view of an upright of the system, showing its supporting tripod and a lower transverse member associated with the upright.

Once the uprights 28 have been fixed to their tripods 14, as described above, the transverse perpendicularity of the uprights is adjusted by means of the screws 26 associated with the feet 24. By "transverse perpendicularity" is meant perpendicularity relative to a vertical plane normal to the base line LB (FIG. 1).

A plurality of pairs of transverse slots **42*a*, 42*b* is cut into the center of each U-shaped upright element 30, or into that surface defining the flat face 38. The pitch of the slots 42*a*, on the one hand, and of the slots 42*b* on the other hand, are constant. The distance between the two slots 42*a*, 42*b*** of each pair is of a predetermined value, which will be specified below.

Figure 6:
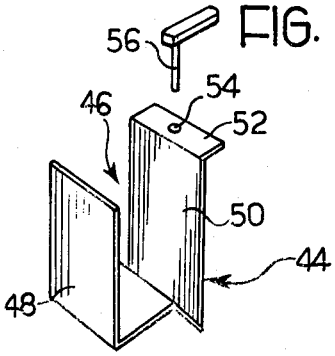
FIG. 6 is a perspective view of a hooked coupling element used to fasten a stringer to an upright of the system.

The slots **42*a*, 42*b* comprise fixing means in which, in the most convenient fastening arrangement, it is possible to attach hooked coupling elements 44 which are shown installed in FIGS. 2, 4, 7 and 10, and in detail in FIG. 6. Each hooked coupling 44 comprises a sheet metal element bent in such manner as to form a substantially U-shaped holder 46 which is square in cross-section. The holder 46 has a pair of sheet metal sides 48, 50. A flat flange 52 is bent outwardly at right angles from the free edge of the side 50 and is provided with a hole 54**.

Each hooked coupling element 44 is attached to a U-shaped element 30 by inserting the tongue 52 into one of the respective slots **42*a*, 42*b*, are required, in such manner that the side 50 is in contact with the respective flat face 38 and the hole 54 lies adjacent the opposite, internal, face of the U-shaped upright element 30 to receive a retaining pin 56. Attached coupling elements 44 are clearly visible in FIGS. 7 and 10. In these positions the holders 46** open upwardly.

As shown also in FIG. 1, the hooked coupling elements 44 are spaced along the uprights 28 at arbitrary vertical intervals of, for example, 30 cm to 80 cm.

Stringers 58 are inserted in the holders 46 of the attached coupling elements 44, as shown in FIGS. 1, 2, 4, 7 and 11.

Each stringer 58 comprises a channel-section beam 60 with flat external faces which are parallel to each other. The channel of the beam 60 is occupied by a square-sectioned batten 62 of wood, or similar soft material, which is retained in the channel of the beam 60 by nails or screws 64. The batten 62 has an exposed face 66 which corresponds to the open side of the channel beam 60 and is flush with the free edges of the sides of the channel beam.

The stringers 58 preferably have square cross-sections, the lengths of the sides corresponding to the distance between the sides 48, 50 of the holders 46 of the hooked coupling elements 44. The height of the holder sides 48, 50 is, however greater than the length of the aforesaid section side, in order that each holder 46 may receive at least two overlapping stringers 58, as shown in FIG. 4.

The stringers 58 have sufficient length, for example, 2 m to 4 m, to extend between at least two adjacent uprights 28 arranged at a reasonable distance from each other.

Adjacent uprights 28 are thus connected at least in pairs by stringers 58 which are inserted in coupling elements 44 attached at intervals up the uprights 28.

Figure 4:
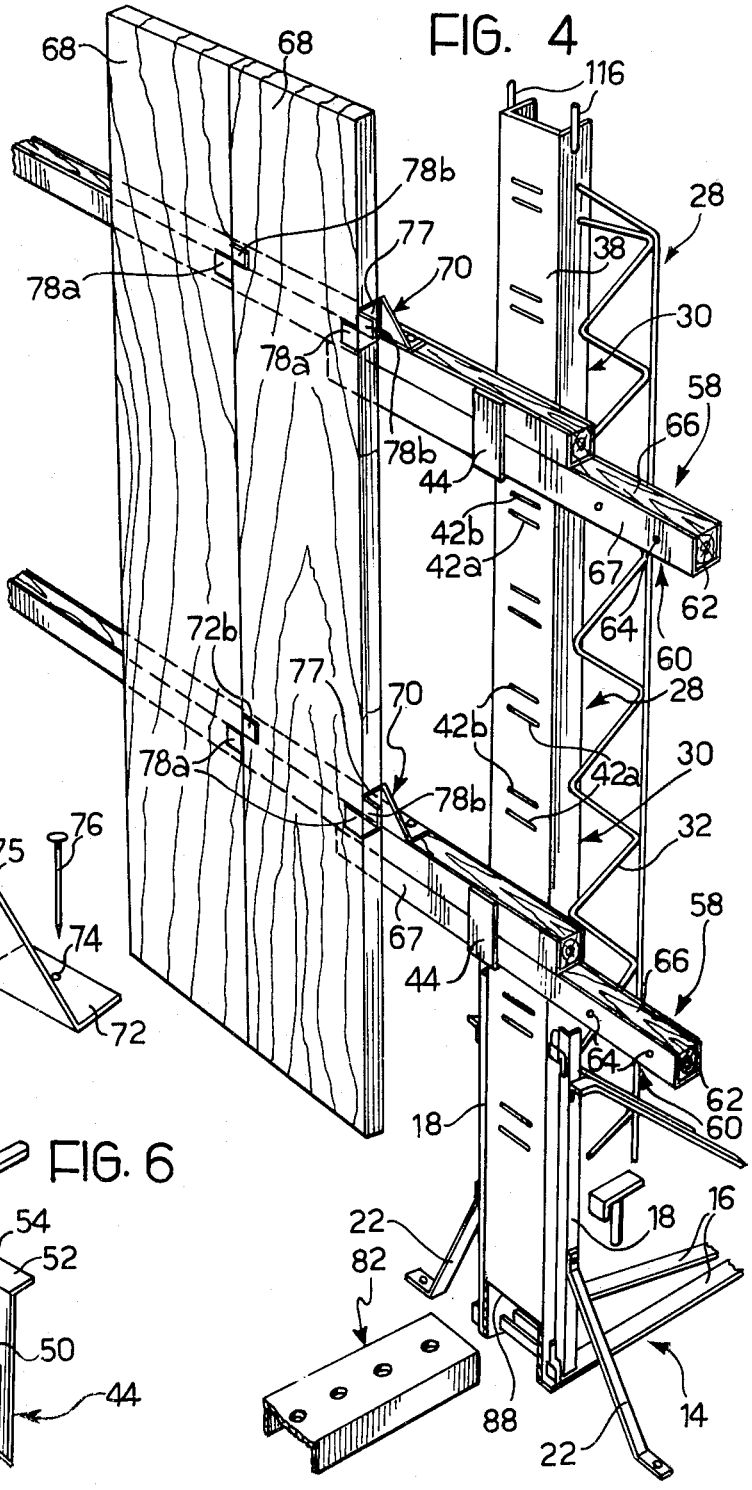
FIG. 4 is a perspective view of a detail of the system showing means of connection between the uprights and the panels.

When two adjacent uprights 28 have been connected to start a row, the row may be extended by inserting additional overlapping stringers 58 to the coupling elements 44 on the said two uprights, as shown in FIG. 4, these stringers 58 being connected with further uprights 28. The latter stringers 58 may be similarly overlapped at their other ends by further stringers connecting yet other uprights in the row. Alternatively, these other ends may each be supported by the bottom of the holder 46 of a respective coupling element 44. In this alternative case, a coupling element 44 holding two overlapping stringers 58 will be inserted in the lower slot 42*a* of a pair of slots in one upright 28, whilst the other end of the uppermost stringer 58 will be supported by the bottom of a holder 46 of a coupling element 44 fixed in the upper slot 42*b* of a corresponding pair of slots in the adjacent upright 28.

The way in which the stringers 58 are arranged to connect the uprights 28 may be chosen as appropriate in each case.

Prior to being interconnected by stringers 58 the uprights 28 must be aligned accurately, the accuracy being improved by the fitting of the stringers 58 into the holders 46 of the coupling elements 44. Once the uprights 28 are aligned, the transverse perpendicularity may be adjusted by the screws 26.

Upon the alignment of the uprights 28 the flat faces 67 of the stringers 58, which are opposite those faces adjacent the flat faces 38 of the uprights, define a vertical plane.

As a result of the way in which the stringers 58 are held in the holders 46 of the coupling elements 44, it is possible for the stringers 58 to slide horizontally parallel to their length. Therefore, since the stringers 58 are not held in any particular position relative to uprights 28, the spacing between the adjacent uprights 28 can be selected as desired, and the stringers 58 need not project beyond the position in which a wall or partition is to stand upon completion, enabling, for example, the link-up of walls placed at 90° to each other, or the uninterrupted casting of a wall or partition with a 90° corner.

Figure 7:
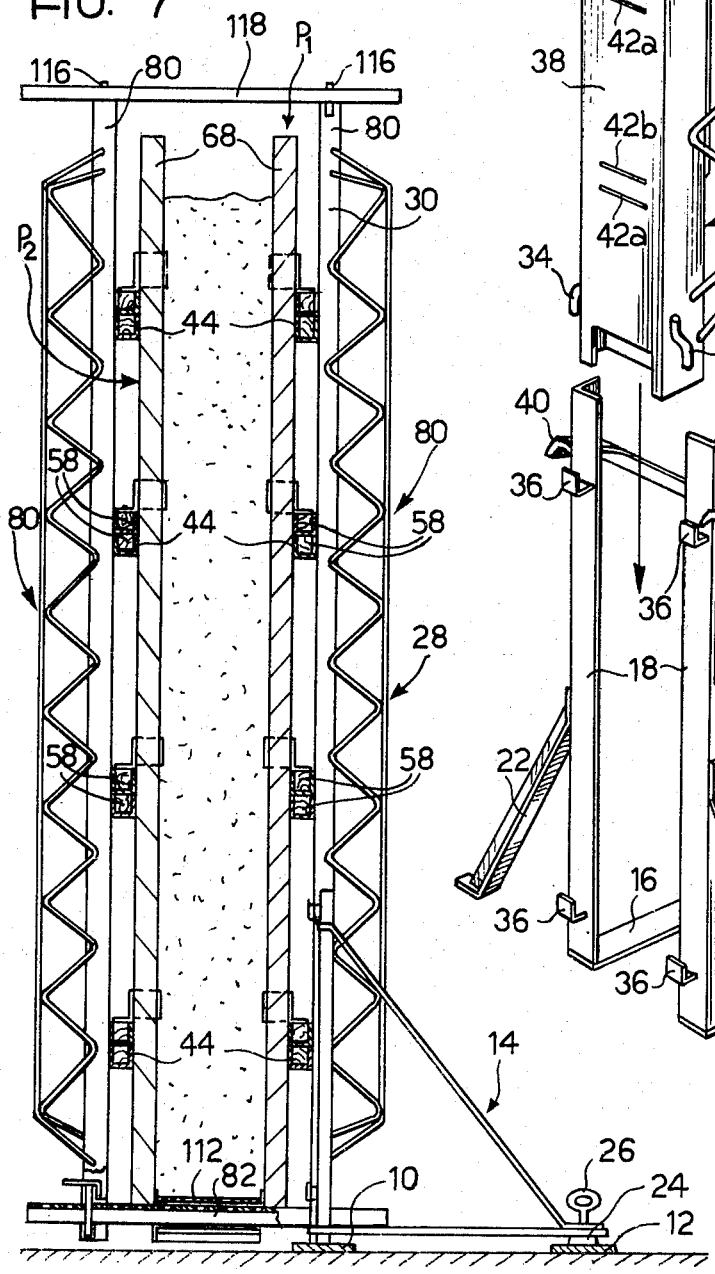
FIG. 7 is a cross section, on an enlarged scale, taken along the line VII—VII of FIG. 1.

As shown in FIGS. 4 and 7, each stringer 58 is installed with the exposed batten face 66 of soft material facing upwards.

Once the structure of uprights 28 and stringers 58 described above has been formed, a first surface $P_1$ (FIGS. 1, 7 and 10) defining the concrete casting cavity is formed. In order to form this surface $P_1$, consecutive panels 68 are fastened to the flat faces 67 of the stringers 58. The panels 68 are arranged with their length vertical, while their horizontal width may be selected as desired. The panels 68 used may be of any suitable material, particularly simple wooden boards of the type usually used for shuttering.

Figure 8:
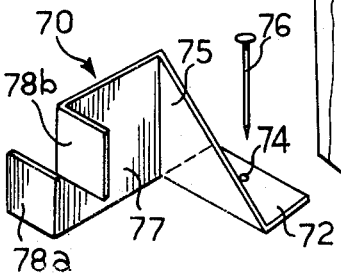
FIG. 8 is a perspective view of a retaining bracket for fixing consecutive panels to a stringer.

Each panel 68 is fixed to the stringers 68 by means of retaining brackets 70, as shown in FIGS. 2 and 4 and better seen in FIG. 8.

Each retaining bracket 70 is formed from cut and bent sheet metal, and includes a side piece 72 for fastening to the exposed upper face 66 of the stringer batten 62. The side piece 72 has at least one hole 74 for a nail 76 or the like, which may be driven into the wood, or other soft material, of the batten 62. The side piece 72 is connected by means of a vertical triangular gusset plate 76 to a plate 77 which is perpendicular to the side piece 72 and the gusset plate 75. The edge of the plate 77 opposite the gusset plate 75 has a pair of retaining flanges 78*a*, 78*b* bent at right angles to and on opposite sides of the plate 77 (FIG. 8).

When a panel 68 is placed against the flat face 67 of a stringer 58 for fastening, a bracket 70 is fixed to the stringer 58 in such a way that the flange 78*a* retains the panel 68 between itself and the face 67, with the plate 77 against the edge of the panel. A nail 76 is then driven into batten 62. The next panel 68 is fixed by inserting it between the face 67 and the other retaining flange 78*b*. In this manner plate 77 extends through the vertical gap between the adjacent panels 68.

The assembly of the first shuttering surface $P_1$ is completed when adjacent panels 68 have been fixed to define the entire length of the wall or partition to be cast.

The choice of an economical material, such as wood, for the panels 68 enables a selection of panels of different widths to be available, thus enabling the erection of a shuttering surface of exactly the same length as the wall or partition to be cast.

The subsequent dismantling of the shuttering, when the concrete has set, may be effected simply by extracting the nails 76, and removing the panels 68 and brackets 70 for re-use.

Figure 10:
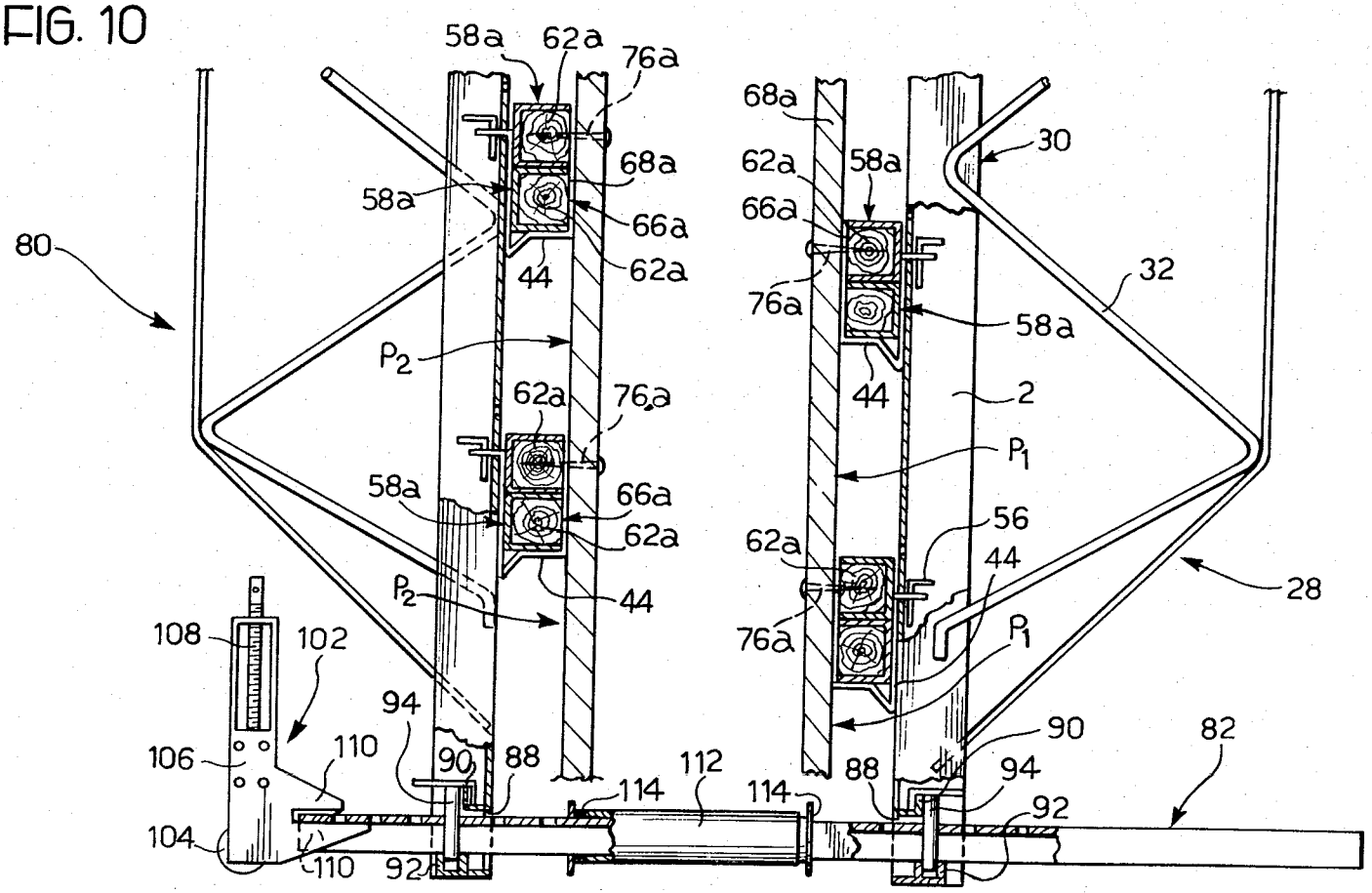
FIG. 10 is a cross section, similar to FIG. 7, of a second embodiment of the system showing a variation in the arrangement of stringers and the fixing of the panels to the stringers, and also showing a truck which engages a lower transverse member to move one row of panels towards the other.

In order to complete the shuttering for the wall or partition to be cast, a second shuttering surface $P_2$ of panels 68 is erected, spaced from the surface $P_1$ described above. For this purpose a second row of uprights 80, similar to the uprights 28, but without supporting tripods 14, is used (FIGS. 1, 7 and 10).

The uprights 80 are again interconnected by means of stringers 58 fastened by hooked coupling elements 44. For the same reasons as described above, the fastening of the stringers 58 by the coupling elements 44 allows alignment of uprights 80 and produces a sufficiently rigid and flat framework, even though the uprights 80 are devoid of supporting tripods. The panels 68 are fixed to this framework by means of brackets 70, to form the second shuttering surface $P_2$.

Obviously, the second surface $P_2$ is spaced from the first surface $P_1$ by a distance which corresponds to the thickness of the wall to be cast and when the wall is to be cast without reinforcing rods this distance may be such that a person may walk between the surfaces $P_1$, $P_2$.

In the majority of cases, however, reinforcing rods (not shown) are used, being placed in position after the first surface $P_1$ has been erected and fixed to the panels 68, together with such falsework as necessary to define door frames, window openings, and other cavities such as pipe ducts. In this case it is convenient to erect the second surface $P_2$ away from the first surface $P_1$. For this purpose, once the first surface $P_1$ has been erected, respective lower transverse connecting members or cross-pieces 82 (FIGS. 1, 2, 4, 5, 7, 9 and 10) are laid out on the ground in transverse alignment with each upright 28.

Each lower cross-piece 82 comprises an inverted U-shaped metal element which has along its center, at one end, a row of holes 84 spaced by a distance $d_1$ (FIG. 5). At the other end the center of the element 82 has a pair of holes 86 spaced by a distance $d_2$, which is less than the distance $d_1$.

The lower parts of the uprights 28,80 have respective openings 88 for the passage of a respective cross-piece 82. As shown in FIG. 9, a respective upper L-section crosspiece 90 and a lower U-section cross-piece 92 are fixed to the U-shaped elements 30 of the uprights 28, 80, within the openings 88. When a cross-piece 82 is placed through the openings 88 of two opposing uprights 28, 80, respective locking members 94, shown in FIG. 9, are used to fix the uprights to the cross-piece. Each locking member 94 includes a pin 96, preferably of frusto-conical shape, which is inserted, as required, into the holes 82 or the holes 86 so that its end is received by the channel of the lower U-section crosspiece 92. The pin 96 has a flat L-shaped head 98, one arm 100 of which engages the upper L-section cross-piece 90 as shown in FIGS. 7 and 10.

As will be appreciated, which of the holes 82, 86 are selected will determine the distance between the two shuttering surfaces $P_1$, $P_2$, that is, the thickness of the wall or partition to be cast. In order to provide a wider range of widths, therefore, the distance $d_1$ between the holes 82 may be 5 cm, and the distance $d_2$ between the two holes 86 may be 2.5 cm. This enables wall thicknesses to be selected at intervals of 2.5 cm.

In order to erect the second surface $P_2$, as described above, at a convenient distance from the first surface $P_1$, which has already been plumbed, the uprights 80 are fixed to the cross-piece 82, in an erect position and at the selected distance, by the locking members 94.

Once erected, the structure of the second surface $P_2$ is moved towards the first surface $P_1$. If the structure of the second surface $P_2$ is heavy, the corresponding ends of the cross-pieces 82 are engaged by respective trucks 102 (FIG. 10). Each truck 102 is provided with a small bearing wheel 104 and includes a slide 106 which is displaced vertically by a screw device 108. The slide 106 has a double fork 110 into which the end of the cross-piece 82 is engaged. The displacement of the second shuttering surface $P_2$ is then effected by lifting the upright 80 from the ground to run on the wheel 104 of the truck 102. As the second surface $P_2$ approaches surface $P_1$, the cross-pieces 82 are placed in their respective openings 88 in the uprights 28 (if not already in position), and then locked by the locking members 94. In this way the base of the now internal face of the second surface $P_2$ is spaced from the opposing internal face of the first surface $P_1$ by a distance equal to the thickness of the wall or partition to be cast.

If no provision is made, the cross-pieces 82 will remain embedded in the concrete of the wall and be beyond recovery. In practice, each cross-piece 82 is fitted with a sleeve 112 of rigid material such as sheet metal or plastics (FIGS. 2, 7 and 10). An annular flanged bushing 114 is fitted onto the cross-piece 82 adjacent each end of the sleeve 112 to abut respective surfaces $P_1$, $P_2$ of the casting cavity and prevent the sleeve 112 filling with concrete.

When the shuttering has been dismantled, the sleeves 112 will remain embedded in the hardened concrete and the cross-pieces 82 may be withdrawn.

In order to complete the transverse connection between the two shuttering surfaces $P_1$, $P_2$, the upper parts of the opposing uprights 28, 80 are also connected transversely.

The top of each upright 28, 80 has a pair of pins 116, preferably of frusto-conical shape (FIGS. 1, 2, 4 and 7), which are interconnected, as shown in FIGS. 1, 2 and 7, by means of pairs of upper transverse connecting members or cross-pieces 118. Each upper cross-piece 118 is identical to the lower cross-pieces 82 and has holes 120 and 122 similar to the holes 84, 86, respectively, of the lower cross-pieces.

The pins 116 are engaged, as desired, in the holes 120, 122 so as to obtain a spacing between the tops of the two surfaces $P_1$, $P_2$ equal to the thickness of the wall or partition to be cast.

This determination of the upper spacing serves to plumb the second surface $P_2$, the first surface $P_1$ having been plumbed previously.

FIG. 10 shows a variation in the arrangement of the stringers and the fastening of the panels to the stringers: the hooked coupling elements 44 are still used, but the stringers 58*a* are fitted with the exposed face 66*a* of the battens 62*a* facing the panels 68*a*. This allows panels 68*a* of a soft material, such as wood, to be fixed by nails 76*a* driven in from the faces of the panels 68*a* forming the shuttering surface. The panels 68*a* may be the usual wooden planks mentioned above, but the embodiment of FIG. 10 is particularly suited to the use of panels 68*a* which are to form an integral part of the wall or partition, such as, for example, panels of thermally- and/or acoustically-insulating material. In this case the use of the retaining brackets 70 described above would be impractical, since the brackets 70 could not be withdrawn. It is, however, possible to remove the stringers 58*a* from the nails 76*a* and to render the projecting points of the nails flush with the panels 68*a*.

A shuttering system such as that illustrated according to the invention is suitable for casting in one step the perimeter walls and internal partitions of a storey of a building, following an arrangement which will be immediately apparent from FIG. 1.

The shuttering corresponding to the various walls or partitions are all erected in the manner described above and are connected at the corners. Insofar as the external corners are concerned, the stringers 58 may project, as shown in FIG. 11. This projection is beneficial since it enables the fitting of thrust-bearing elements 124, (FIG. 12) to the projections. Each thrust-bearing element 124 comprises a C-shaped section 126 which embraces the associated stringer 58 and has holes 128 allowing the element 124 to be nailed to the soft batten 62 of the stringer 58. At one of its ends, the element 124 carries a pair of abutment flanges 130, with reinforcing gusset plates 132, which are applied against the stringers 58 where they cross each other, and bear the thrust of the liquid concrete without the need for an upright 28, 80 at the corner.

At the internal corners, where the stringers 58 cannot project beyond the corner panels 68, connecting elements or right-angled stringers, similar to the usual stringers 58, are used. As shown in FIG. 13, a connecting element comprises two C-shaped sections 60*a*, 60*b* which are welded together at right angles and contain respective nailed battens 62*a*, 62*b* of wood or similar soft material.

In FIGS. 11 and 13 the exposed faces of the stringer battens 62, 62*a*, 62*b* face upwardly for use with brackets 70. When used in the variation of FIG. 10, however, the exposed faces will face the panels 68.

I claim:

1. In a shuttering system for casting a concrete wall or partition comprising:

metal uprights arranged to face each other in two spaced-apart rows;

respective panels fastened to said uprights of each said row to form a pair of flat opposing surfaces which define a casting cavity for said concrete;

respective adjustable support means associated with each said upright in one row to maintain said uprights in their vertical positions of use and enable adjustment of the transverse perpendicularity of said uprights and the respective said surface supported thereby, and respective upper and lower transverse connecting members which interconnect the upper and lower parts of respective said uprights facing each other across said cavity, said transverse connecting members enabling adjustment of the spacing between said upper and lower parts of said uprights, whereby the perpendicularity of said surface supported by said uprights in the other said row is adjustable to ensure said surfaces are parallel, the improvements wherein:

a plurality of fixing means are spaced along each upright on it side which, in use, faces said casting cavity;

coupling elements are provided for fastening to said fixing means;

stringers are engageable with at least two said coupling elements fixed at substantially the same level in respective said fixing means on adjacent said uprights, in such a way that a flat side of said stringer faces said casting cavity and defines a vertical plane with said flat sides of neighbouring stringers, each said stringer at least partially comprising a soft material which forms an exposed face of said stringer;

fastening means are driven into and retained by said soft material of said stringers to fasten said panels to said flat side of said stringers, and said panels are elongate with arbitrary widths, and are fastened to said stringers side-by-side.

2. A shuttering system as defined in claim 1, wherein said stringers have a square cross section, and wherein each said coupling element comprises a hooked sheet metal element having a substantially U-shaped holder of square cross section corresponding to that of said stringers for receiving the latter, said element being fastened to said fixing means of a said upright so that one side of said holder abuts said side of said upright facing said cavity and said holder opens upwardly.

3. A shuttering system as defined in claim 2, wherein said side of each said upright which faces said cavity is formed by a flat surface of sheet metal; said fixing means comprise a plurality of pairs of slots cut in said surface to be horizontal in use, and each said hooked coupling element includes a flange which is bent outwardly at right angles from said side of said holder and, in use, passes through a respective said slot, said flange having a hole which, in use, is located on the opposite side of said upright from said flat surface and receives a pin for retaining said coupling element in said slot.

4. A shuttering system as defined in claim 2, wherein said holders receive at least two overlapping said stringers, and said fixing means are spaced along said uprights by distances substantially equal to the width of the sides of said stringers.

5. A shuttering system as defined in claim 2, wherein each said stringer comprises a respective channel-section beam occupied by a batten of said soft material, said exposed face being the face of said batten corresponding to the open side of said channel-section beam.

6. A shuttering system as defined in claim 5, wherein said flat side of said stringer comprises said exposed face of said batten, said stringers engage said holders of said coupling elements with said exposed face directed towards said casting cavity, and wherein said panels are made from a material which can be pierced by said driven fastening means for fixing said panels to said battens.

7. A shuttering system as defined in claim 5, wherein said flat side of each said stringer comprises a side of said channel beam; said holders receive said stringers with said exposed faces directed upwardly, and wherein said shuttering system includes retaining brackets of sheet metal comprising: a side piece which is fastened to said exposed face and has a hole for a driven fastening element; a plate which is perpendicular to said side piece and, in use, extends through a gap between adjacent said panels, and a pair of retaining flanges bent at right angles to, and on opposite sides of, said plate for abutting the faces of said adjacent panels which define said surfaces of said casting cavity.

8. A shuttering system as defined in claim 1, wherein said system includes thrust-bearing elements for fixing to the portions of two said stringers which overlap when said stringers project beyond a corner from by two said panels at right angles, each said bearing element comprising a C-shaped section which embraces the projecting part of one said stringer, and abutment flanges which abut the projecting part of the other said stringer.

9. In a method of assembling a shuttering system for casting a concrete wall or partition, comprising the steps of:

arranging metal uprights to oppose each other in two rows;

interconnecting upper and lower parts of each opposing pair of said uprights by means of respective upper and lower transverse connecting members which permit the spacing between said upper and lower parts to be adjusted;

attaching panels to said uprights of each row so that said panels are adjacent each other and define, between said rows, respective flat opposing surfaces delimiting a casting cavity for said concrete;

adjusting the transverse perpendicularity of one said row of uprights so as to adjust the perpendicularity of said surface supported thereby, and adjusting the spacing between said upper and lower parts of said uprights to adjust the perpendicularity of said surface supported by said other row of uprights, to ensure said surfaces are parallel, an improvement wherein:

stringers are attached at different levels to the sides of said uprights facing said cavity when said adjustments of said rows of uprights have been effected, so that each of said stringer interconnects at least two adjacent said uprights in a respective said row, and so that a flat side of said stringer faces said casting cavity and defines a vertical plane with said flat sides of neighbouring stringers, each said stringer at least partially comprising a soft material which forms an exposed face of said stringer, and said panels are fastened side-by-side to said flat sides of said stringers with fastening means driven into said exposed faces, said panels being elongate with arbitrary widths.

10. A method as defined in claim 9, wherein said attachment of said stringers permits sliding of the latter lengthwise.

* * * * *